US008862037B2

(12) United States Patent
Fujioka

(10) Patent No.: US 8,862,037 B2
(45) Date of Patent: Oct. 14, 2014

(54) TRANSFER DEVICE, PROCESS UNIT, IMAGE FORMING APPARATUS, AND BEARING

(71) Applicant: Michio Fujioka, Nagoya (JP)

(72) Inventor: Michio Fujioka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 76 days.

(21) Appl. No.: 13/630,669

(22) Filed: Sep. 28, 2012

(65) Prior Publication Data

US 2013/0142550 A1 Jun. 6, 2013

(30) Foreign Application Priority Data

Dec. 2, 2011 (JP) ..... 2011-264817

(51) Int. Cl.
*G03G 15/16* (2006.01)
*G03G 21/16* (2006.01)

(52) U.S. Cl.
CPC ..... *G03G 15/161* (2013.01); *G03G 21/1652* (2013.01)
USPC ..... 399/313

(58) Field of Classification Search
USPC ..... 399/313
See application file for complete search history.

(56) References Cited

U.S. PATENT DOCUMENTS

2011/0211872 A1* 9/2011 Hori et al. ..... 399/313

FOREIGN PATENT DOCUMENTS

| | | |
|---|---|---|
| JP | 02-029677 | 1/1990 |
| JP | 05-313510 | 11/1993 |
| JP | 06-035344 | 2/1994 |
| JP | 10-186897 | 7/1998 |
| JP | 11-190944 | 7/1999 |
| JP | 11-338280 | 12/1999 |
| JP | 11-352808 | 12/1999 |
| JP | 2006-133489 | 5/2006 |
| JP | 2006-243443 | 9/2006 |
| JP | 2006-330352 | 12/2009 |

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A transfer device is provided, which includes a transfer roller that is provided with a conductive rotational shaft, opposed to an external image-carrying body, and configured to transfer onto an image-transferred member a developer image carried by the image-carrying body, and a bearing rotatably supporting the rotational shaft of the transfer roller, the bearing including a conductive section that is disposed in a position around the rotational shaft of the transfer roller and configured to bear the rotational shaft from an opposite side of the image-carrying body with respect to the rotational shaft and to be supplied with electricity from an external power supply, and an insulated section that is disposed in a position around the rotational shaft and configured to cover the image-carrying body from a side of the image-carrying body.

11 Claims, 9 Drawing Sheets

TRANSFER DEVICE, PROCESS UNIT, IMAGE FORMING APPARATUS, AND BEARING

CROSS-REFERENCE TO RELATED APPLICATION

This application claims priority under 35 U.S.C. §119 from Japanese Patent Application No. 2011-264817 filed on Dec. 2, 2011. The entire subject matter of the application is incorporated herein by reference.

BACKGROUND

1. Technical Field

The following description relates to one or more techniques for an electrophotographic image forming apparatus, and a transfer device, a process unit, and a bearing provided in the image forming apparatus.

2. Related Art

An electrophotographic image forming apparatus has been known that has a transfer device including an image carrying body configured to carry a developer image and a transfer member configured to electrically transfer the developer image carried on the image carrying body onto a recording medium.

As one of examples of the transfer device, a transfer device has been known that includes an intermediate transfer belt as the image carrying body, a transfer roller as the transfer member, and an opposed roller. The transfer roller, which is electrically conductive, is pressed against and in contact with the intermediate transfer belt. The opposed roller is opposed to the transfer roller across the intermediate transfer belt.

In the known transfer device, a rotational shaft of the transfer roller is borne by an electrically conductive rolling bearing. Further, the rolling bearing is supported by an insulating slider that is movable in a direction along which the opposed roller is opposed to the transfer roller. Thereby, the rotational shaft of the transfer roller is supplied with a transfer bias via the rolling bearing. In addition, the slider prevents discharge of the transfer bias between the transfer roller and the opposed roller.

SUMMARY

In the known transfer device, the rolling bearing is provided to cover an outer circumferential surface of the rotational shaft of the transfer roller. Hence, in order to electrically isolate the rolling bearing, the slider needs to be provided to cover an outer circumferential surface of the rolling bearing. Therefore, it is difficult to downsize the rolling bearing and the slider.

Aspects of the present invention are advantageous to provide one or more improved techniques to attain a compact bearing configured to bear a transfer roller.

According to aspects of the present invention, a transfer device is provided, which includes a transfer roller that has a conductive rotational shaft, the transfer roller being opposed to an external image-carrying body configured to carry a developer image, the transfer roller being configured to transfer onto an image-transferred member the developer image carried by the image-carrying body, and a bearing configured to rotatably support the rotational shaft of the transfer roller, the bearing including a conductive section formed of conductive material, the conductive section being disposed in a position around the rotational shaft of the transfer roller, the conductive section being configured to bear the rotational shaft from an opposite side of the image-carrying body with respect to the rotational shaft and to be supplied with electricity from an external power supply, and an insulated section formed of insulating material, the insulated section being disposed in a position around the rotational shaft, the insulated section being configured to cover the image-carrying body from a side of the image-carrying body.

According to the transfer device configured as above, as the rotational shaft is borne by the conductive section from the opposite side of the image-carrying body with respect to the rotational shaft, the rotational shaft is supplied with electricity from the external power supply.

Further, since the rotational shaft is covered by insulated section from the side of the image-carrying body, it is possible to prevent discharge between the rotational shaft and the image-carrying body.

Therefore, it is possible to dispose the conductive section and the insulated section such that they do not overlap in a radial direction of the rotational shaft and bear the rotational shaft by cooperation between the conductive section and the insulated section.

Consequently, it is possible to downsize the bearing in the radial direction of the rotational shaft and attain a compact configuration for bearing the rotational shaft of the transfer roller.

According to aspects of the present invention, further provided is a process cartridge configured to be detachably attached to an apparatus main body, the process cartridge including an image carrying body configured to carry a developer image, a transfer roller that has a conductive rotational shaft, the transfer roller being opposed to the image carrying body, the transfer roller being configured to transfer onto an image-transferred member the developer image carried by the image carrying body, and a bearing configured to rotatably support the rotational shaft of the transfer roller, the bearing including a conductive section formed of conductive material, the conductive section being disposed in a position around the rotational shaft of the transfer roller, the conductive section being configured to bear the rotational shaft from an opposite side of the image carrying body with respect to the rotational shaft and to be supplied with electricity from an external power supply, and an insulated section formed of insulating material, the insulated section being disposed in a position around the rotational shaft, the insulated section being configured to cover the image carrying body from a side of the image carrying body.

According to aspects of the present invention, further provided is an image forming apparatus that includes a process cartridge configured to be detachably attached to an apparatus main body, the process cartridge including an image carrying body configured to carry a developer image, a transfer roller having a conductive rotational shaft, the transfer roller being opposed to the image carrying body, the transfer roller being configured to transfer onto an image-transferred member the developer image carried by the image carrying body, and a bearing configured to rotatably support the rotational shaft of the transfer roller, the bearing including a conductive section formed of conductive material, the conductive section being disposed in a position around the rotational shaft of the transfer roller, the conductive section being configured to bear the rotational shaft from an opposite side of the image carrying body with respect to the rotational shaft and to be supplied with electricity from an outside of the process cartridge, and an insulated section formed of insulating material, the insulated section being disposed in a position around the rotational shaft, the insulated section being configured to cover the image carrying body from a side of the image carrying body, and a power supply configured to supply electricity to the conductive section.

According to aspects of the present invention, further provided is an image forming apparatus that includes an image carrying body configured to carry a developer image, a transfer device including a transfer roller that has a conductive rotational shaft, the transfer roller being opposed to the image carrying body, the transfer roller being configured to transfer onto an image-transferred member the developer image carried by the image carrying body, and a bearing configured to rotatably support the rotational shaft of the transfer roller, the bearing including a conductive section formed of conductive material, the conductive section being disposed in a position around the rotational shaft of the transfer roller, the conductive section being configured to bear the rotational shaft from an opposite side of the image carrying body with respect to the rotational shaft and to be supplied with electricity from an outside of the transfer device, and an insulated section formed of insulating material, the insulated section being disposed in a position around the rotational shaft, the insulated section being configured to cover the image carrying body from a side of the image carrying body, and a power supply configured to supply electricity to the conductive section.

According to aspects of the present invention, further provided is a bearing configured to rotatably support a conductive rotational member, the bearing including a conductive section formed of conductive material, the conductive section being disposed in a position around the rotational member, the conductive section being configured to bear the rotational member and to be supplied with electricity from an external power supply, and an insulated section formed of insulating material, the insulated section being disposed in a position adjacent to the conductive section around the rotational member.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, embodiments according to aspects of the present invention will be described with reference to the accompanying drawings.

1. Overall Configuration of Printer

Figure 1:
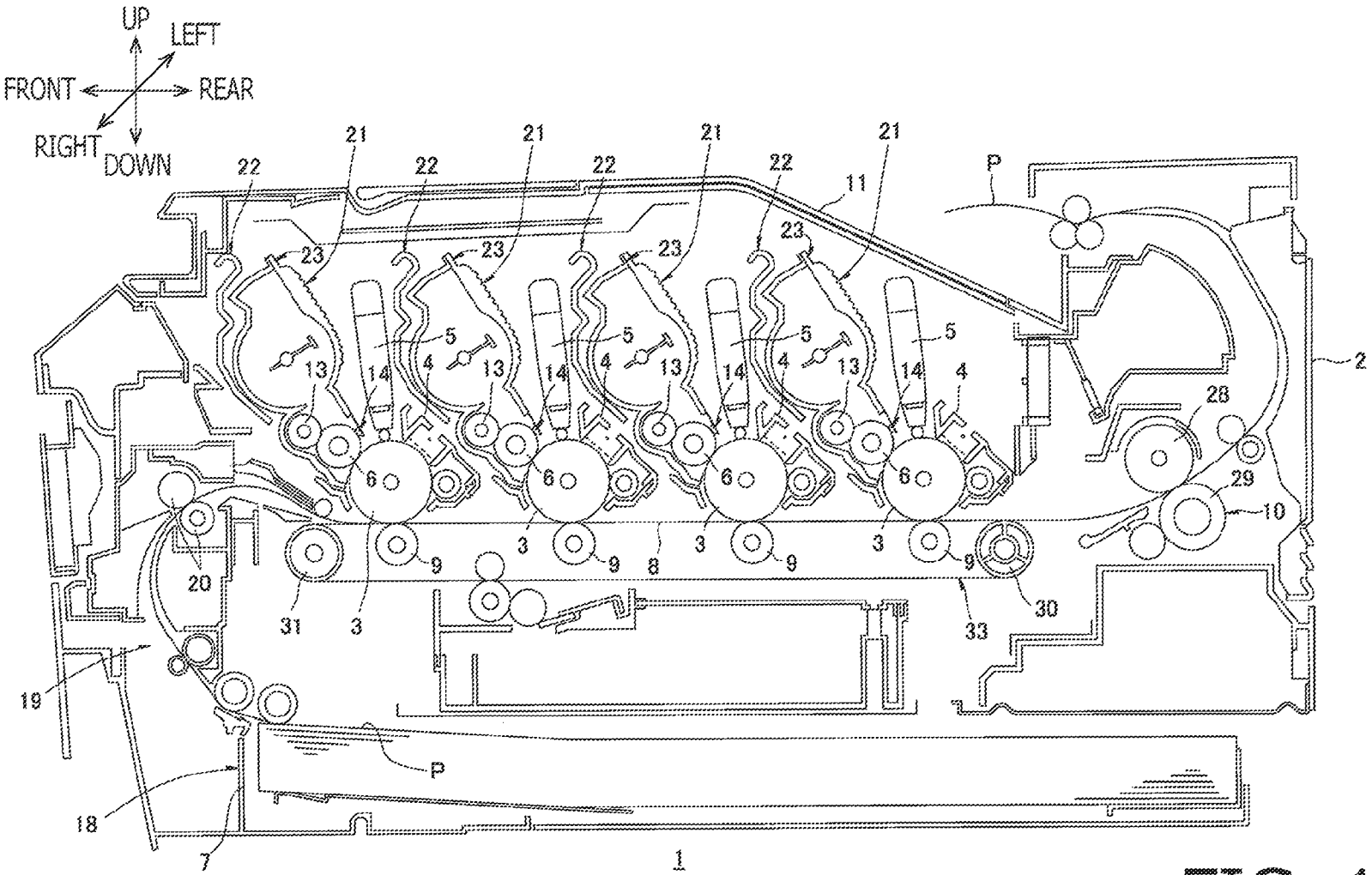
FIG. 1 is a cross-sectional side view showing a configuration of a printer in a first embodiment according to one or more aspects of the present invention.

As shown in FIG. 1, a printer 1 of a first embodiment is a transversely-installed direct-tandem color laser printer. The printer 1 includes, in a main body casing 2 thereof, a sheet feeding unit 18 configured to feed sheets P, and an image forming unit 19 configured to form images on the fed sheets.

It is noted that, in the following description, an upside, a downside, a front side, a rear side, and a left side, and a right side of the printer 1 will be defined as shown in the accompany drawings.

The sheet feeding unit 18 is disposed at a bottom portion in the casing 2. The sheet feeding unit 18 includes a feed tray 7 that accommodates the sheets P, and two registration rollers 20 disposed at an upper front side relative to the feed tray 7. The sheet P are fed from the feed tray 7 toward between the registration rollers 20 and conveyed toward the image forming unit 19 at respective predetermined moments.

The image forming unit 19 includes four process cartridges 21 and four LED units 5 that are provided for respective four colors. The image forming unit 19 further includes a belt unit 33 and a fuser 10.

The four process cartridges 21 correspond to black, yellow, magenta, and cyan, respectively. The four process cartridges 21 are arranged in parallel with each other at intervals in the front-to-rear direction, above the belt unit 33

Further, each process cartridge 21 includes a drum cartridge 22, and a development cartridge 23 detachably attached to the drum cartridge 22.

The drum cartridge 22 includes a photoconductive drum 3 and a scorotron charger 4.

The photoconductive drum 3 is formed in a substantially cylindrical shape to extend in the left-to-right direction.

The scorotron charger 4 is disposed to face the photoconductive drum 3 across a predetermined distance at an upper rear side relative to the photoconductive drum 3.

The development cartridge 23 is disposed to face the photoconductive drum 3 at an upper front side relative to the photoconductive drum 3. The development cartridge 23 includes a development roller 6, a supply roller 13, and a layer thickness regulating member 14. Further, the development cartridge 23 has a portion that accommodates toner above the development roller 6, the supply roller 13, and the layer thickness regulating member 14.

Each of the four LED units 5 is disposed to face a corresponding one of the photoconductive drums 3. Each LED unit 5 is configured to expose the corresponding photoconductive drum 3 based on predetermined image data.

The belt unit 33 is disposed along the front-to-rear direction in such a position as to contact all the process cartridges 21 from below, above the sheet feeding unit 18 in the main body casing 2. The belt unit 33 includes a driving roller 30, a driven roller 31, a conveying belt 8, and four transfer rollers 9.

The driving roller 30 is disposed at a rear end of the belt unit 33.

The driven roller 31 is disposed at a front end of the belt unit 33 so as to face the driving roller 30 across a predetermined distance.

The conveying belt 8 is wound around a pair of the driving roller 30 and the driven roller 31 such that an upper portion thereof contacts all the process cartridges 21 from below. The conveying belt 8 is configured to revolve such that the upper portion thereof travels rearward from the front side in response to the driving roller 30 being driven to rotate.

The four transfer rollers 9 are arranged in parallel with each other at intervals in the front-to-rear direction, between the driving roller 30 and the driven roller 31. Specifically, each of the four transfer rollers 9 is disposed to face a corresponding one of the four photoconductive drums 3 across the conveying belt 8, such that the conveying belt 8 is pinched between the transfer roller 9 and the photoconductive drum 3.

Figure 3:
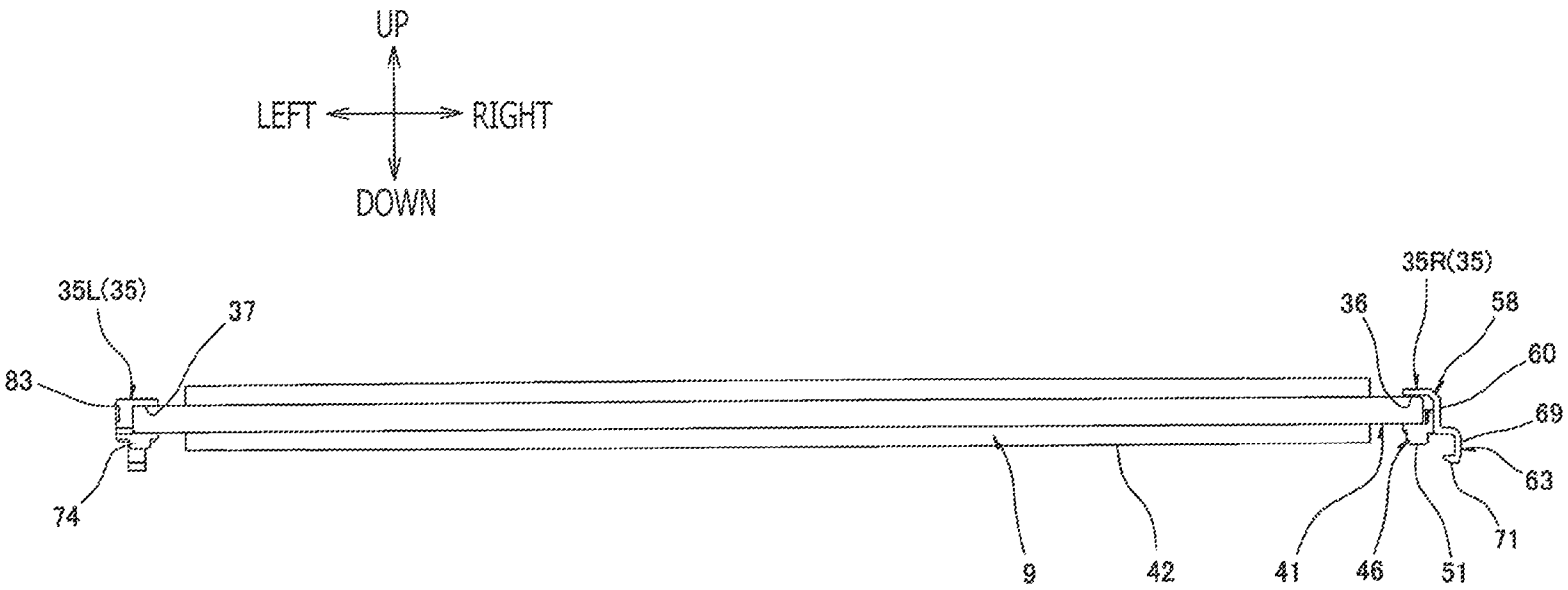
FIG. 3 is a cross-sectional front view showing a transfer roller and bearing members of the belt unit in the first embodiment according to one or more aspects of the present invention.

Further, each of the four transfer rollers 9 includes a transfer roller shaft 41 and a rubber roller 42, for example, as shown in FIG. 3.

The transfer roller shaft 41 is formed of metal, in a substantially cylindrical shape to extend in the left-to-right direction.

The rubber roller 42 is formed of electrically conductive resin, in a substantially cylindrical shape to extend in the left-to-right direction. The rubber roller 42 is configured to cover the transfer roller shaft 41 such that both end portions of the transfer roller shaft 41 in the left-to-right direction are exposed.

As shown in FIG. 1, the fuser 10 includes a heating roller 28 and a pressing roller 29 opposed to the heating roller 28.

The toner in the development cartridge 23 is positively charged in a frictional manner between the supply roller 13 and the development roller 6. Then, the toner is regulated by the layer thickness regulating member 14 to be a thin layer with an even thickness and carried on a surface of the development roller 6.

Meanwhile, a surface of the photoconductive drum 3 is evenly and positively charged by the scorotron charger 4 in response to rotation of the photoconductive drum 3 and then exposed by the LED unit 5. Thereby, an electrostatic latent image is formed on the surface of the photoconductive drum 3.

When the photoconductive drum 3 further rotates, the toner carried on the surface of the development roller 6 is supplied to the electrostatic latent image on the surface of the photoconductive drum 3. Thereby, a toner image, that is, a developer image is carried on the surface of the photoconductive drum 3.

A sheet P fed from the sheet feeding unit 18 is conveyed rearward from the front side by the conveying belt 8 to sequentially pass through between each of the four photoconductive drums 3 and the corresponding transfer roller 9.

By a transfer bias applied to each transfer roller 9, the toner images carried on the photoconductive drums 3 are sequentially transferred onto the sheet P. Hereinafter, the operation that a color image is formed on the sheet P by the toner images being transferred onto the sheet P will be referred to as a "transfer operation".

After that, the toner images are thermally fixed onto the sheet P as being heated and pressed while the sheet P passes through between the heating roller 28 and the pressing roller 29.

The sheet P with the toner images fixed thereon is fed toward an upper rear side in a U-turn manner, and ejected onto a catch tray 11 that is formed on an upper wall of the main body casing 2.

2. Detailed Configuration of Belt Unit

Figure 2:
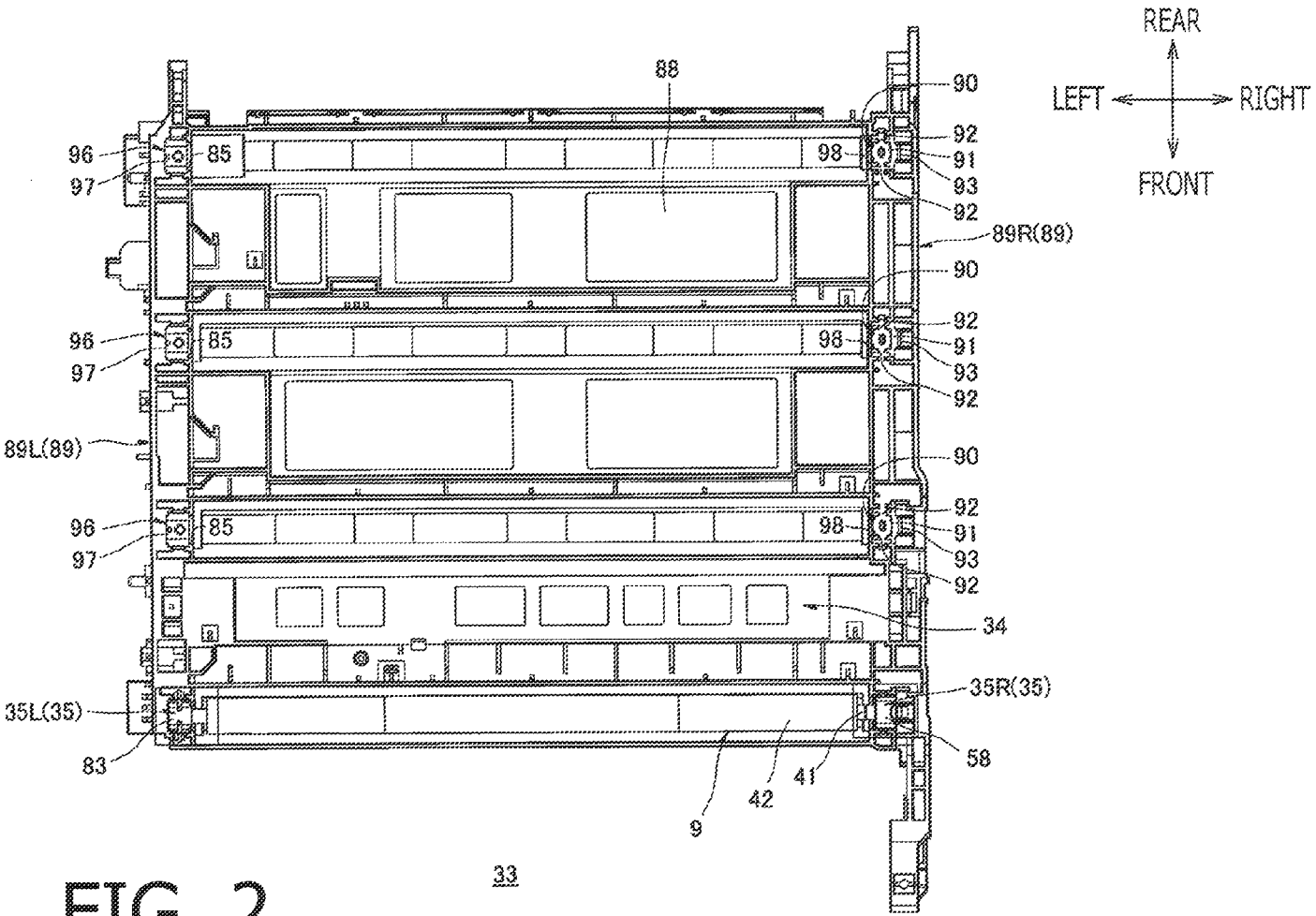
FIG. 2 is a top view showing a transfer frame of a belt unit of the printer in the first embodiment according to one or more aspects of the present invention.

As shown in FIGS. 1 and 2, the belt unit 33 includes a transfer frame 34 and bearing members 35 configured to rotatably bear the transfer roller shafts 41.

(1) Transfer Frame

The transfer frame 34 is formed in a substantially rectangular-frame shape when viewed from the upper side. The transfer frame 34 is provided integrally with two side frame members 89 that are disposed to face each other across a predetermined distance in the left-to-right direction, and a bottom plate 88 disposed between the two side frame members 89.

It is noted that, in the following description, a left one and a right one of the side frame members 89 will be referred to as a left side frame portion 89L and a right side frame portion 89R, respectively.

The right side frame portion 89R is formed in a substantially plate shape to extend in the front-to-rear direction and provided with four attaching portions 90.

The four attaching portions 90 are arranged in parallel with each other at such intervals in the front-to-rear direction as to correspond to the four transfer rollers 9, respectively.

Figure 4A:
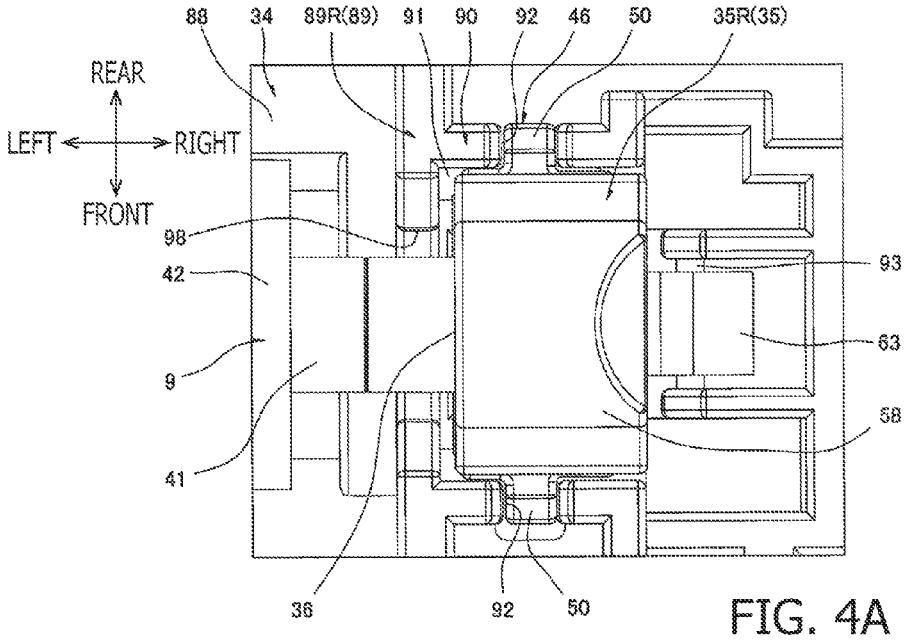
FIG. 4A is a top view showing a major part of the belt unit in the first embodiment according to one or more aspects of the present invention.
Figure 4B:
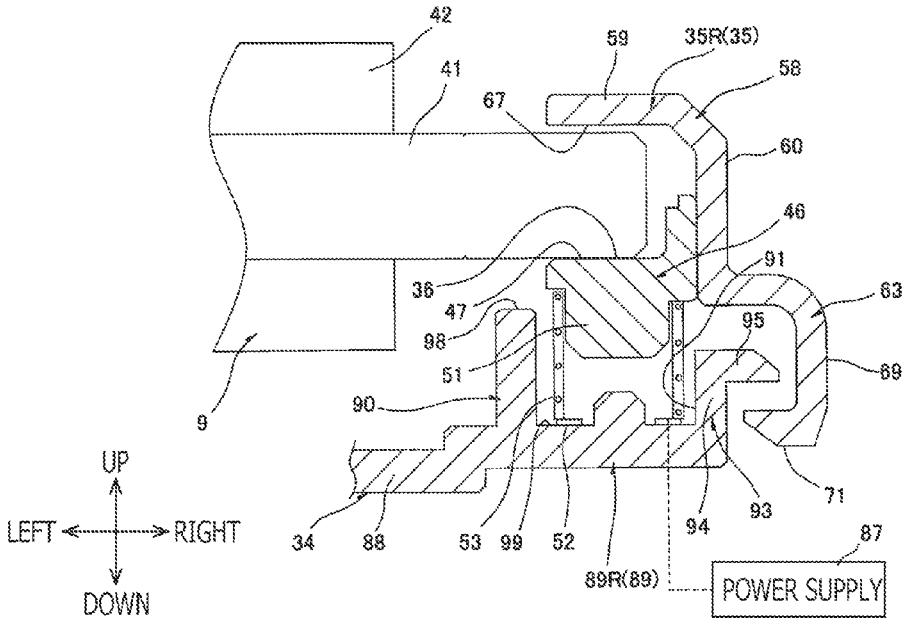
FIG. 4B is a cross-sectional front view showing the major part of the belt unit in the first embodiment according to one or more aspects of the present invention.

As shown in FIGS. 4A and 4B, each of the four attaching portions 90 includes an attachment hole 91, guide grooves 92, and a shaft fitting groove 98 configured such that the corresponding transfer roller shaft 41 is fitted thereinto.

The attachment hole 91 is recessed downward to a bottom wall 99 of the attaching portion 90 from an upper surface of the attaching portion 90 and formed in a substantially rectangular shape when viewed from the upper side. Further, in the attachment hole 91, there are provided an electrode 52, an urging member 53, and a frame-side hook 93.

The electrode 52 is disposed at a bottom surface of the attachment hole 91, that is, the bottom wall 99 of the attaching portion 90. The electrode 52 is electrically connected with a power supply 87 in the main body casing 2.

The urging member 53 is a metal helical compression spring configured to expand and contract up and down. A lower end of the urging member 53 is disposed to face a substantially central portion of the bottom surface of the attachment hole 91 in the front-to-rear direction, so as to be electrically connected with the electrode 52.

The frame-side hook 93 is formed in a substantially hook shape to extend upward from a right end of the bottom surface of the attachment hole 91. Specifically, the frame-side hook 93 includes an erecting portion 94 formed to extend upward from the bottom surface of the attachment hole 91 and a hook engagement portion 95 formed to protrude rightward from an upper end of the erecting portion 94. An upper surface of a right end of the hook engagement portion 95 is slanted to become lower toward the right side.

Each guide groove 92 is recessed outward from an inner surface of the attachment hole 91 in the front-to-rear direction and formed in a substantially rectangular shape when viewed from the upper side. Further, each guide groove 92 is formed to extend from an upper end to the bottom surface of the attachment hole 91.

At a left end of the right side frame portion 89R, that is, an inner end of the right side frame portion 89R in the left-to-right direction, the shaft fitting groove 98 is continuous with a center of the attachment hole 91 in the front-to-rear direction. The shaft fitting groove 98 is formed as a groove recessed downward from an upper end of the right side frame portion 89R. A groove width of the shaft fitting groove 98, that is, a length of the shaft fitting groove 98 in the front-to-rear direction is longer than a diameter of the transfer roller shaft 41.

As shown in FIG. 2, the left side frame portion 89L is formed in a substantially plate shape to extend in the front-to-rear direction and provided with four attaching portions 96.

The four attaching portions 96 are arranged in parallel with each other at such intervals in the front-to-rear direction as to correspond to the four transfer rollers 9, respectively, in the same manner as the attaching portions 90 of the aforementioned right side frame portion 89R. Each of the four attaching portions 96 includes an attachment hole 97 and a fitting groove 85.

The attachment hole 97 is recessed downward from an upper surface of the attaching portion 96 and formed in a substantially rectangular shape when viewed from the upper side.

At a right end of the left side frame portion 89L, that is, an inner end of the left side frame portion 89L in the left-to-right direction, the fitting groove 85 is continuous with a center of the attachment hole 97 in the front-to-right direction. The fitting groove 85 is formed as a groove recessed downward from an upper end of the left side frame portion 89L. A groove width of the fitting groove 85, that is, a length of the fitting groove 85 in the front-to-rear direction is longer than the diameter of the transfer roller shaft 41.

The bottom plate 88 is provided over between the left side frame portion 89L and the right side frame portion 89R and formed in a substantially rectangular shape when viewed from the upper side.

(2) Bearing Members

One bearing member 35 is provided at each end in the left-to-right direction of each of the four transfer rollers 9. It is noted that a left one of the bearing members 35 will be referred to as a left bearing member 35L, and a right one of the bearing members 35 will be referred to as a right bearing member 35R.

(2-1) Right Bearing Member

As shown in FIGS. 5A, 5B, 6A and 6B, the right bearing member 35R includes a conductive cover 46 and an insulated cover 58.

Figure 7A:
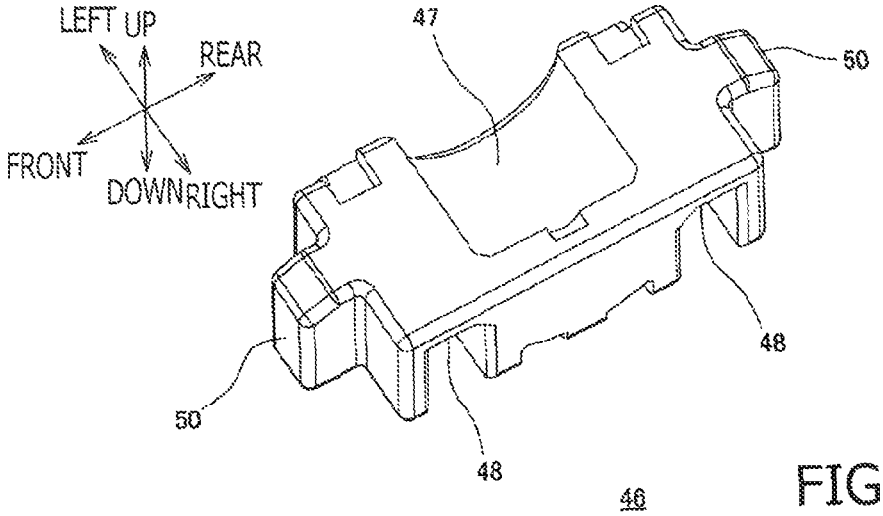
FIG. 7A is a perspective view showing a conductive cover of the right bearing member when viewed from an upper right side in the first embodiment according to one or more aspects of the present invention.
Figure 7B:
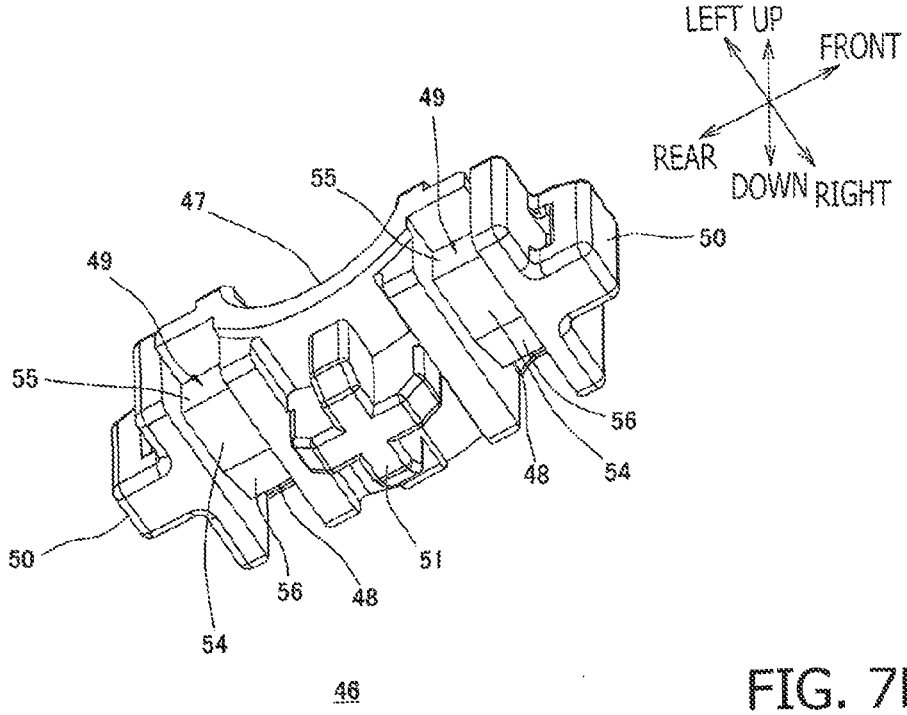
FIG. 7B is a perspective view showing the conductive cover of the right bearing member when viewed from a lower left side in the first embodiment according to one or more aspects of the present invention.

As shown in FIGS. 7A and 7B, the conductive cover 46 is formed of conductive resin material, in a substantially prismatic shape having a longitudinal direction thereof along the front-to-rear direction. The conductive cover 46 includes a supporting portion 47 configured to support a lower half of a right end of the transfer roller shaft 41, recessed fitting portions 48 configured such that protruding fitting portions 61 of the insulated cover 58 are fitted thereinto, guide portions 50 configured to be guided along the guide grooves 92 of the right side frame portion 89R, engagement grooves 49 configured to engage with engagement claws 62 of the insulated cover 58, and an electricity receiving portion 51 configured to receive electric power supply from an external power supply.

The supporting portion 47 is formed in a semicircular shape, when viewed along the left-to-right direction, to be concave downward from an upper surface of the conductive cover 46 substantially in a central region of the conductive cover 46 in the front-to-rear direction. Further, the supporting portion 47 is formed to have a curvature radius slightly larger than a radius of the transfer roller shaft 41.

One recessed fitting portion 48 is provided at each end portion of the conductive cover 46 in the front-to-rear direction. Each recessed fitting portion 48 is formed in a substantially rectangular shape, when viewed along the left-to-right direction, to be recessed leftward from a right surface of the conductive cover 46.

One guide portion 50 is provided at each end of the conductive cover 46 in the front-to-rear direction. Each guide portion 50 is formed to protrude outward from an outer surface of the conductive cover 46 in the front-to-rear direction substantially in a central region of the conductive cover 46 in the left-to-right direction. Further, each guide portion 50 is formed as a projection elongated along the vertical direction.

One engagement groove 49 is formed on a lower side of each of the two recessed fitting portions 48. Each engagement groove 49 includes an arm fitting groove 54 and a claw fitting groove 55.

The arm fitting groove 54 is recessed upward from a lower surface of the conductive cover 46 and formed as a recessed groove extending over an entire length of the conductive cover 46 in the left-to-right direction. Further, at a right end of an upper surface of the arm fitting groove 54, there is provided a tapered surface 56 slanted to become lower toward the left side.

The claw fitting groove 55 is recessed rightward from a left surface of the conductive cover 46 and formed as a recessed groove that continuously extends upward at a left end of the arm fitting groove 54.

The electricity receiving portion 51 is formed in a shape of a cross pillar to protrude downward from the lower surface of the conductive cover 46 when viewed from the lower side.

Figure 8A:
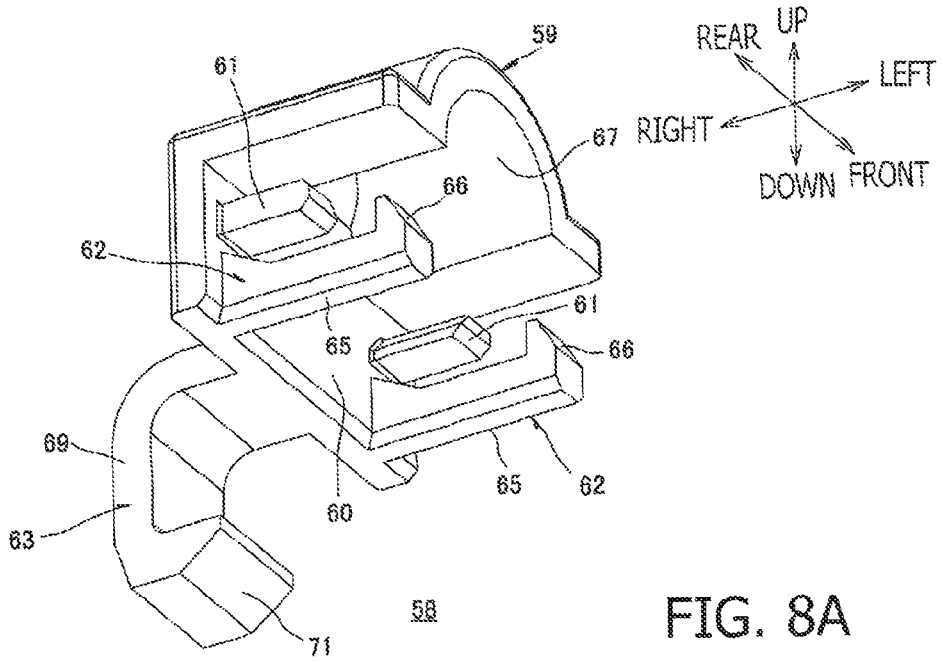
FIG. 8A is a perspective view showing an insulated cover of the right bearing member when viewed from a lower left side in the first embodiment according to one or more aspects of the present invention.
Figure 8B:
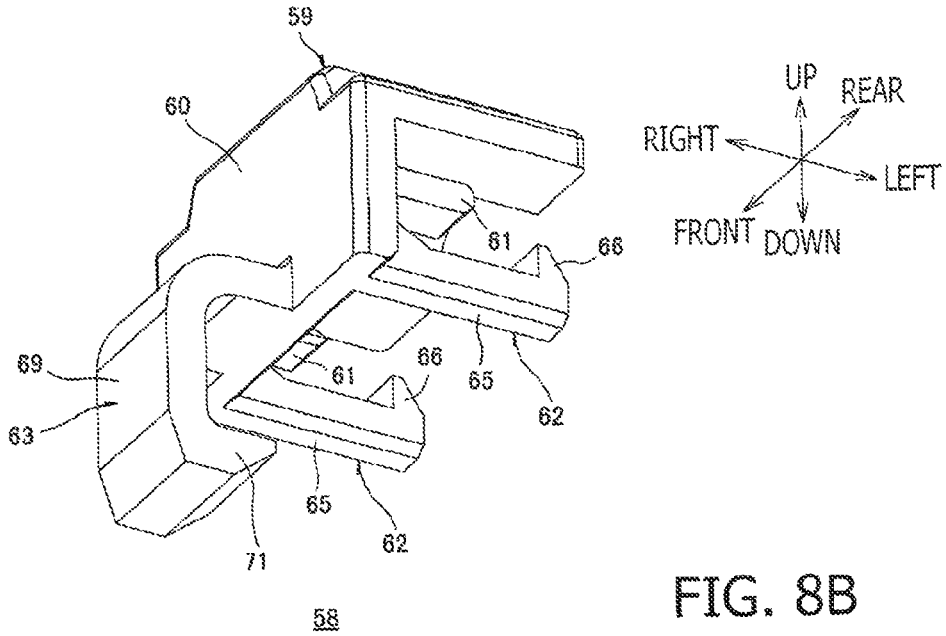
FIG. 8B is a perspective view showing the insulated cover of the right bearing member when viewed from a lower right side in the first embodiment according to one or more aspects of the present invention.

As shown in FIGS. 8A and 8B, the insulated cover 58 includes a covering portion 59 that is formed of insulating resin material to cover a right end of the transfer roller shaft 41 from above, that is, from the side of the photoconductive drum 3, an opposed portion 60 that is opposed to the right end of the transfer roller shaft 41 from the right side, and a bearing-side hook 63 configured to engage with the frame-side hook 93 of the right side frame portion 89R.

The covering portion 59 is provided at an upper end of the insulated cover 58. The covering portion 59 is formed in a shape of a curved plate to extend in the front-to-rear direction. A length in the front-to-rear direction and a length in the left-to-right direction of the covering portion 59 are equivalent to those of a part of the conductive cover 46 other than the guide portions 50, that is, a middle portion of the conductive cover 46. Further, in a central region of the covering portion 59 in the front-to-rear direction, a bearing portion 67 is formed.

The bearing portion 67 is formed in such a half-cylindrical shape that a lower surface of the bearing portion 67 is concave upward. A curvature radius of the lower surface of the bearing portion 67 is slightly larger than the radius of the transfer roller shaft 41.

The opposed portion 60 is formed in a substantially rectangular-plate shape to continuously extend downward from a right end of the covering portion 59. Further, the opposed portion 60 includes protruding fitting portions 61 and engagement claws 62 configured to engage with the engagement grooves 49 of the conductive cover 46.

One protruding fitting portion 61 is provided at each end portion of the opposed portion 60 in the front-to-rear direction, substantially in a central region of the opposed portion 60 in the vertical direction. The protruding fitting portions 61 are configured to be fitted into the recessed fitting portions 48. Each protruding fitting portion 61 is formed in a substantially rectangular-pillar shape to protrude leftward from a left surface of the opposed portion 60.

The engagement claws 62 are disposed with a distance therebetween in the front-to-rear direction such that one engagement claw 62 is provided under each of the protruding fitting portions 61. Each engagement claw 62 is formed in a substantially hook shape to extend leftward from a lower end of the opposed portion 60. Specifically, each engagement claw 62 is provided integrally with an arm portion 65 and a claw portion 66.

The arm portion 65 is formed in a substantially rod shape to extend leftward from the lower end of the opposed portion 60. Further, the arm portion 65 protrudes leftward by a length larger than the protruding fitting portion 61.

The claw portion 66 includes an apical portion that protrudes upward (i.e., toward the photoconductive drum 3) from a left end of the arm portion 65 (i.e., from an inner end of the arm portion 65 in the left-to-right direction). The claw portion 66 is formed in a substantially right-triangle shape, when viewed from the front side, such that a right surface (i.e., an outer surface in the left-to-right direction) of the claw portion 66 extends in the vertical direction.

The bearing-side hook 63 is formed in a substantially hook shape to extend downward from a lower end of a substantially central region of the opposed portion 60 in the front-to-rear direction. Specifically, the bearing-side hook 63 includes an extending portion 69 and a hook portion 71.

The extending portion 69 is formed in a substantially "L" shape, when viewed from the front, to extend rightward from the lower end of the substantially central region of the opposed portion 60 and then extend in a curved manner downward (i.e., toward the opposite side of the photoconductive drum 3 with respect to the insulated cover 58).

The hook portion 71 is formed in a substantially right-triangle shape, when viewed from the front side, to protrude leftward from a lower end of the extending portion 69 and have an apical portion directed leftward and an upper side extending in the left-to-right direction.

(2-2) Left Bearing Member

In the same manner as the right bearing member 35R, the left bearing member 35L includes a conductive cover 74 configured to support a left end of the transfer roller shaft 41 from below, and an insulated cover 83 configured to cover the left end of the transfer roller shaft 41 from above.

(2-3) Assembling of Bearing Members

In assembling of the right bearing member 35R, as shown in FIG. 5, the conductive cover 46 is attached to the insulated cover 58.

Firstly, the conductive cover 46 is placed on the left side of the insulated cover 58, that is, at an inner side relative to the insulated cover 58 in the left-to-right direction. At this time, the conductive cover 46 is placed such that the claw portions 66 of the engagement claws 62 are fitted into the arm fitting grooves 54 of the engagement grooves 49, between the covering portion 59 and the engagement claws 62.

Then, when the conductive cover 46 is pressed against the insulated cover 58, a right end of the upper surface of the conductive cover 46 is rendered in contact with a left end of the lower surface of the covering portion 59 of the insulated cover 58, and the engagement claws 62 of the insulated cover 58 are rendered in contact with the tapered surfaces 56 of the conductive cover 46.

Then, when the conductive cover 46 is further pressed against the insulated cover 58, the engagement claws 62 of the insulated cover 58 are pressed downward along the slope of the tapered surface 56 of the conductive cover 46 such that the arm portions 65 thereof are deformed downward.

Then, when the conductive cover 46 is further pressed against the insulated cover 58, the conductive cover 46 is inserted between the covering portion 59 and the engagement claws 62 of the insulated cover 58 such that the engagement claws 62 of the insulated cover 58 slide relatively leftward in the arm fitting grooves 54 of the claw fitting grooves 55.

The conductive cover 46 is further pressed against the insulated cover 58 until the protruding fitting portions 61 of the insulated cover 58 are fitted into the recessed fitting portions 48 of the conductive cover 46. Thereby, the claw portions 66 of the engagement claws 62 of the insulated cover 58 are positionally coincident with the claw fitting grooves 55 of the engagement grooves 49 of the conductive cover 46. Further, the arm portions 65 of the engagement claws 62 are restored such that the claw portions 66 of the engagement claws 62 are fitted into the claw fitting grooves 55 of the engagement grooves 49.

Further, the arm portions 65 of the engagement claws 62 are fitted into the arm fitting grooves 54 of the engagement grooves 49 so as to support the conductive cover 46 from below. Thereby, right walls of the claw fitting grooves 55 of the engagement grooves 49 are rendered opposed to right surfaces of the claw portions 66 of the engagement claws 62.

Thus, the engagement grooves 49 are engaged with the engagement claws 62, and assembling of the right bearing member 35R is completed.

At this time, the supporting portion 47 of the conductive cover 46 is rendered opposed to the bearing portion 67 of the insulated cover 58 in the vertical direction. Thereby, a bearing hole 36, which is formed in a circular shape when viewed along the left-to-right direction, is defined by an inner circumferential surface (an upper surface) of the supporting portion 47 of the conductive cover 46 and an inner circumferential surface (an lower surface) of the bearing portion 67 of the insulated cover 58.

Figure 6A:
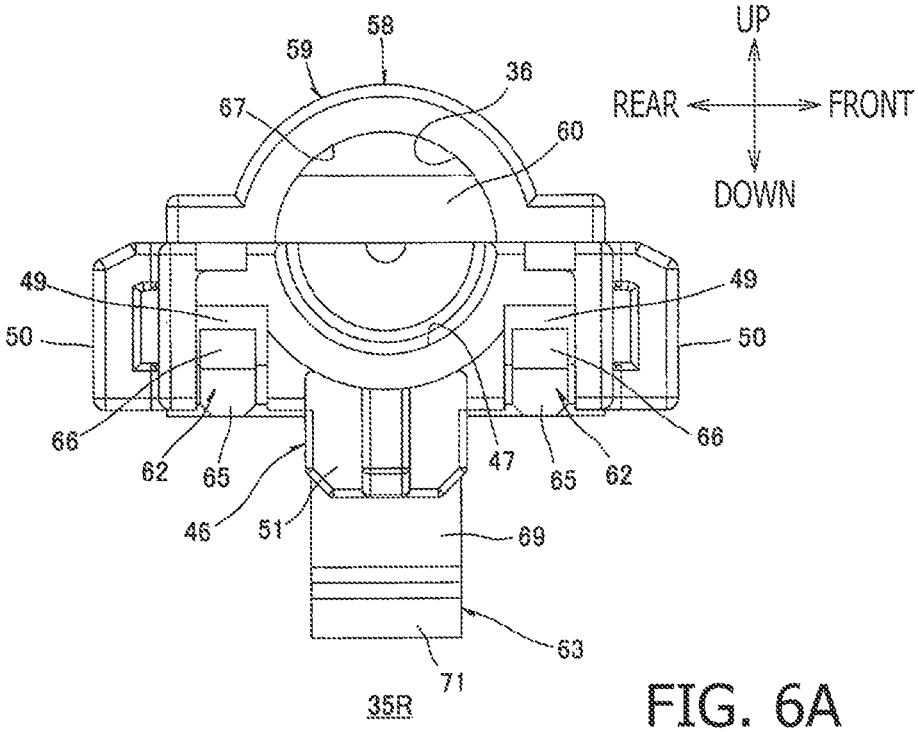
FIG. 6A is a left side view showing the right bearing member of the belt unit in the first embodiment according to one or more aspects of the present invention.
Figure 6B:
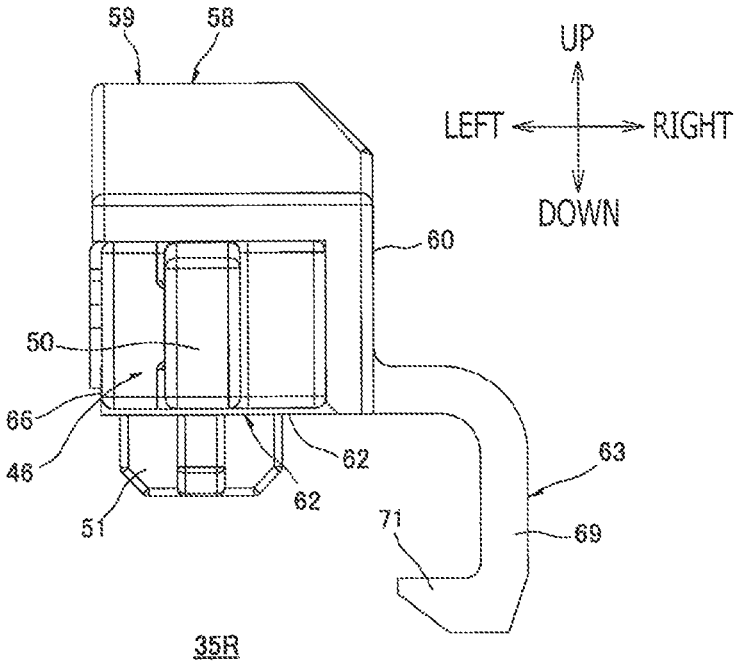
FIG. 6B is a front view showing the right bearing member of the belt unit in the first embodiment according to one or more aspects of the present invention.

As shown in FIG. 6A, the covering portion 59 of the insulated cover 58 is configured to, when projected in the vertical direction, cover the part of the conductive cover 46 other than the guide portions 50, that is, the middle portion of the conductive cover 46.

In order to assemble the left bearing member 35L, in the same manner as the right bearing member 35R, the conductive cover 74 is attached to the insulated cover 83 so as to be covered by the insulated cover 83 from above. In the left bearing member 35L, a bearing hole 37 is defined by an upper surface of the conductive cover 74 and a lower surface of the insulated cover 83.

(3) Attachment of Transfer Rollers to Transfer Frame

As shown in FIG. 3, in order to attach a right end of one transfer roller 9 to the transfer frame 34, a right end of the transfer roller shaft 41 is inserted into the bearing hole 36 of the right bearing member 35R. Further, a left end of the transfer roller shaft 41 is inserted into the bearing hole 37 of the left bearing member 35L.

Then, the right bearing member 35R is placed above the attaching portions 90 of the right side frame portion 89R, and the left bearing member 35L is placed above the attaching portions 96 of the left side frame portion 89L.

Then, the right bearing member 35R is fitted into the attachment hole 91 of the right side frame portion 89R such that the guide portions 50 of the conductive cover 46 are fitted into the guide grooves 92 of the right side frame portion 89R.

Then, the right bearing member 35R is pressed into the attachment hole 91 of the right side frame portion 89R.

Thereby, the right bearing member 35R is moved downward while the guide portions 50 are guided along the guide grooves 92 of the right side frame portion 89R.

Thus, a left end of the hook portion 71 of the bearing-side hook 63 of the right bearing member 35R is rendered in contact with a right end of the hook engagement portion 95 of the frame-side hook 93 of the right side frame portion 89R.

Then, the right bearing member 35R is further pressed into the attachment hole 91 of the right side frame portion 89R. Thereby, the bearing-side hook 63 is deformed rightward along the slanted surface of the right end of the hook engagement portion 95, and the frame-side hook 93 is deformed leftward along the slanted surface of the left end of the hook portion 71.

Then, when the right bearing member 35R is further pressed into the attachment hole 91 of the right side frame portion 89R, the contact between the hook portion 71 of the bearing-side hook 63 and the hook engagement portion 95 of the frame-side hook 93 is released. Thereby, the bearing-side hook 63 and the frame-side hook 93 are restored, and the hook portion 71 of the bearing-side hook 63 is placed under the hook engagement portion 95 of the frame-side hook 93. Thus, the bearing-side hook 63 of the insulated cover 58 is engaged with the frame-side hook 93 of the transfer frame 34.

At the same time, the conductive cover 46 is rendered in contact with an upper end portion of the urging member 53 from above, such that the electricity receiving portion 51 is fitted into the upper end portion of the urging member 53. Thereby, the conductive cover 46 is electrically connected with the external power supply 87 via the urging member 53 and the electrode 52 and always urged upward by the urging member 53.

The transfer roller shaft 41 is fitted into the shaft fitting groove 98 with an allowance therebetween, near the left side of the right bearing member 35R.

Thereby, the right bearing member 35R is completely attached to the right side frame portion 89R of the transfer frame 34.

At this time, the conductive cover 46 is directly fitted into the attachment hole 91 of the attaching portion 90, and the insulated cover 58 is directly latched by the attaching portion 90. Namely, the transfer roller shaft 41 is positioned relative to the attaching portion 90 via the conductive cover 46.

At the same time, in the same manner as the right bearing member 35R, when the left bearing member 35L is attached into the attaching portion 96 of the left side frame portion 89L, the transfer roller 9 is completely attached to the transfer frame 34.

4. Operations and Advantageous Effects

According to the printer 1 and the belt unit 33 of the first embodiment, as shown in FIG. 3, as the transfer roller shaft 41 is supported by the conductive cover 46 from below (i.e., from the opposite side of the photoconductive drum 3 with respect to the transfer roller shaft 41), the transfer roller shaft 41 is electrically connected with the power supply 87.

Further, as the transfer roller shaft 41 is covered by the insulated cover 58 from above, that is, from the side of the photoconductive drum 3, it is possible to avoid discharge between the transfer roller shaft 41 and the photoconductive drum 3.

Therefore, it is possible to dispose the conductive cover 46 and the insulated cover 58 such that they do not overlap in the radial direction of the transfer roller shaft 41 and to bear the transfer roller shaft 41 by cooperation between the conductive cover 46 and the insulated cover 58.

Thereby, it is possible to downsize the bearing member 35 in the radial direction of the transfer roller shaft 41 and attain a compact configuration for bearing the transfer roller shaft 41 of the transfer roller 9.

Consequently, it is possible to downsize the belt unit 33 and the printer 1.

Further, according to the printer 1 and the belt unit 33, as shown in FIG. 4A, it is possible to position the transfer roller shaft 41 relative to the transfer frame 34 by using the conductive cover 46.

For example, when the transfer roller shaft 41 is doubly covered with the conductive cover 46 and the insulated cover 58, the transfer roller shaft 41 is positioned relative to the transfer frame 34 by the outside insulated cover 58. In this case, in order to reach the transfer roller shaft 41 from the transfer frame 34, it is required to go through the two components, i.e., the conductive cover 46 and the insulated cover 58. Hence, owing to dimensional tolerances of the conductive cover 46 and the insulated cover 58, it is impossible to precisely position the transfer roller shaft 41 relative to the transfer frame 34.

On the contrary, in each bearing member 35 of the first embodiment, since the transfer roller shaft 41 is positioned relative to the transfer frame 34 solely by the conductive cover 46, it is possible to precisely position the transfer roller shaft 41 relative to the transfer frame 34.

Therefore, it is possible to precisely position the transfer roller shaft 41 relative to the transfer frame 34 with achievement of fewer components than when the transfer roller shaft 41 is positioned relative to the transfer frame 34 via one or more other components.

Thus, it is possible to easily and precisely position the transfer roller shaft 41 and the conductive cover 46 relative to the transfer frame 34.

Further, according to the printer 1 and the belt unit 33 of the first embodiment, as shown in FIG. 4A, when the conductive cover 46 is attached to the attaching portion 90, it is possible to guide the guide portions 50 of the conductive cover 46 along the guide grooves 92 of the attaching portion 90.

Therefore, it is possible to smoothly attach the conductive cover 46 to the transfer frame 34.

Further, according to the printer 1 and the belt unit 33 of the first embodiment, as shown in FIG. 4B, it is possible to directly engage the insulated cover 58 of the bearing member 35 with the attaching portion 90 of the transfer frame 34.

Therefore, it is possible to prevent the insulated cover 58 from being detached from the attaching portion 90.

Further, according to the printer 1 and the belt unit 33 of the first embodiment, as shown in FIG. 6A, the covering portion 59 covers the middle portion of the conductive cover 46, that is, the part of the conductive cover 46 other than the guide portions 50 when projected from the upper side to the lower side (i.e., from the side of the photoconductive drum 3 to the side of the transfer roller 9).

Therefore, it is possible to cover and electrically isolate, with the covering portion 59 of the isolated cover 58, an upper end portion of the circumferential surface of the transfer roller shaft 41 that is the closest to a lower end portion of the circumferential surface of the photoconductive drum 3.

Thus, it is possible to further prevent discharge between the transfer roller shaft 41 and the photoconductive drum 3.

Figure 5A:
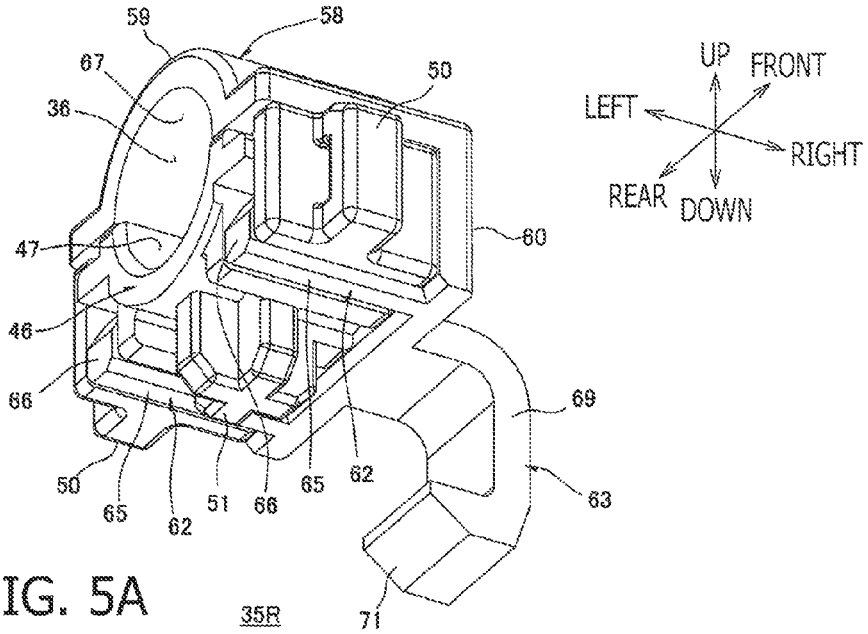
FIG. 5A is a perspective view showing a right one of the bearing members (a right bearing member) of the belt unit when viewed from a lower left side in the first embodiment according to one or more aspects of the present invention.
Figure 5B:
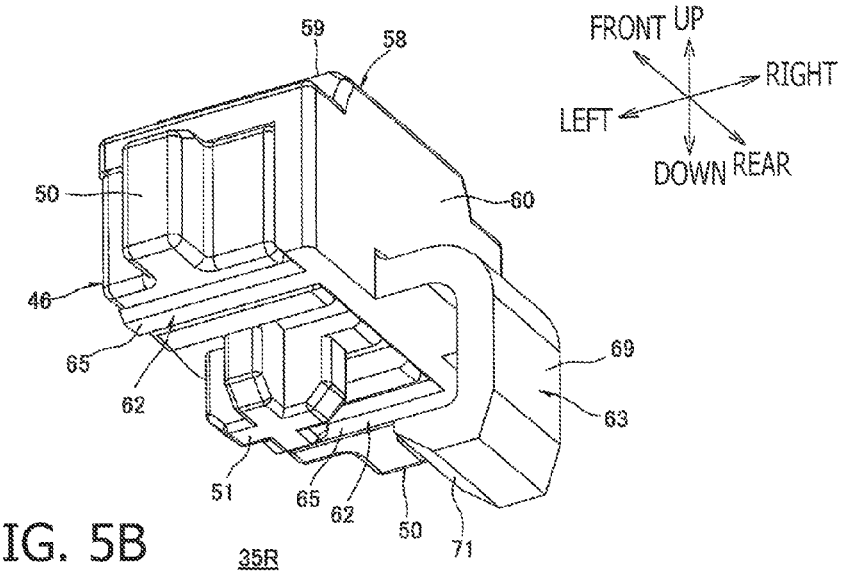
FIG. 5B is a perspective view showing the right bearing member of the belt unit when viewed from a lower right side in the first embodiment according to one or more aspects of the present invention.

Further, according to the printer 1 and the belt unit 33 of the first embodiment, as shown in FIGS. 4B, 5A, and 5B, the opposed portion 60 restricts the transfer roller shaft 41 from sliding rightward. Further, the conductive cover 46 is supported by the engagement claws 62 of the insulated cover 58 from below (i.e., from the opposite side of the photoconductive drum 3 with respect to the conductive cover 46).

Therefore, it is possible to prevent the transfer roller shaft 41 from being detached rightward. Further, it is possible to prevent the conductive cover 46 from being detached downward (i.e., toward the opposite side of the photoconductive drum 3 with respect to the conductive cover 46).

Moreover, according to the printer 1 of the first embodiment, as shown in FIGS. 5A *and* 5B, it is possible to allow the protruding fitting portions 61 of the insulated cover 58 to be fitted into the recessed fitting portions 48 of the conductive cover 58 from the right side (i.e., from the outside of the conductive cover 58 in the axis line direction of the transfer roller shaft 41).

Therefore, it is possible to fix the conductive cover 46 to the insulated cover 58 in the vertical direction (i.e., an opposed direction in which the conductive cover 46 is opposed to the insulated cover 58) and the front-to-rear direction (i.e., the direction perpendicular to the axis line direction and the opposed direction).

Additionally, according to the printer 1 of the first embodiment, as shown in FIG. 4B, the belt unit 33 includes the electrode 52 electrically connected with the conductive cover 46, and the electrode 52 is supplied with electricity from the power supply 87 of the main body casing 2.

Therefore, the electricity from the power supply 87 is sequentially transmitted through the electrode 52 and the conductive cover 46 and then supplied to the transfer roller shaft 41.

Thus, it is possible to downsize each bearing member 35 in the radial direction of the transfer roller shaft 41.

5. Second Embodiment

Subsequently, referring to FIGS. 3 and 9, a printer 1 of a second embodiment will be described. The same elements of the printer 1 of the second embodiment as those of the aforementioned first embodiment will be attached with the same reference characters, and explanations about them will be omitted.

In the aforementioned embodiment, the printer 1 is configured as a direct-tandem color laser printer with process cartridges provided for respective four colors. In the second embodiment, the printer 1 is configured as a monochrome printer having a process cartridge for black.

Figure 9:
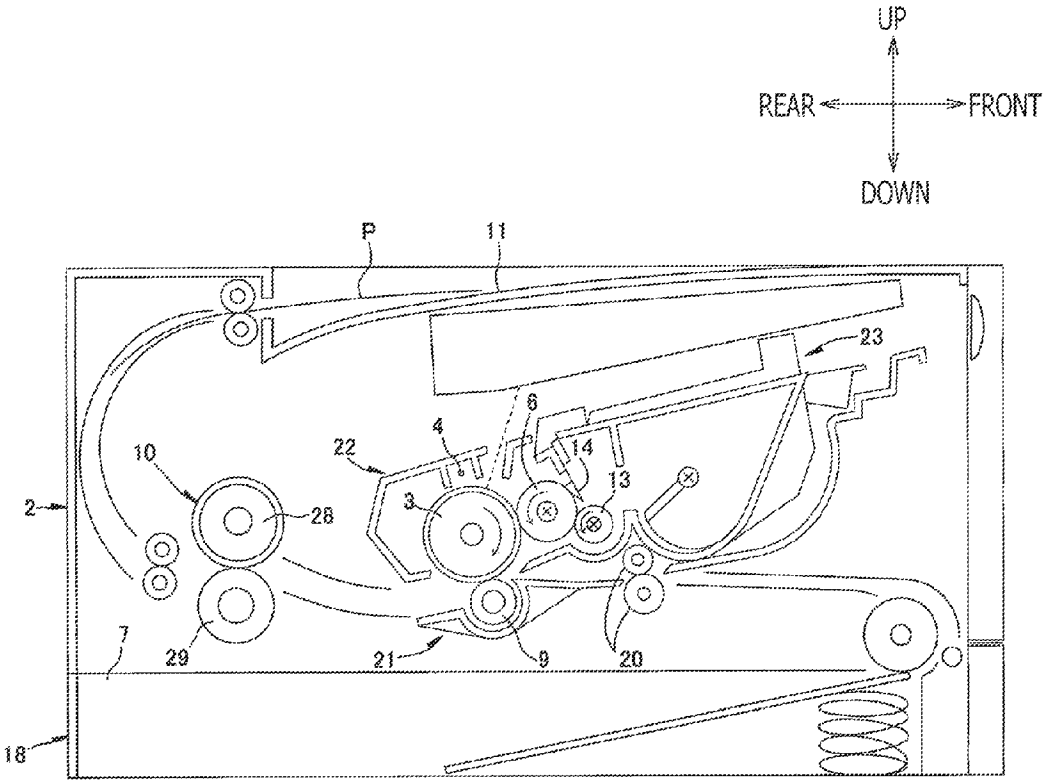
FIG. 9 is a cross-sectional side view showing a configuration of a printer in a second embodiment according to one or more aspects of the present invention.

Specifically, as shown in FIG. 9, the printer 1 includes a single process cartridge 21.

The process cartridge 21 includes a drum cartridge 22 detachably attached to a main body casing 2 and a development cartridge 23 detachably attached to the drum cartridge 22.

The drum cartridge 22 includes a photoconductive drum 3, a scorotron charger 4, and a transfer roller 9.

The development cartridge 23 is provided with a development roller 6, a supply roller 13, and a layer thickness regulating member 14 and configured to accommodate toner.

In the second embodiment as well, as shown in FIG. 3, a transfer roller shaft 41 of the transfer roller 9 is rotatably supported by the drum cartridge 22 via bearing members 35 that are configured in the same manner as the first embodiment.

In the printer 1 and the process cartridge 21 of the second embodiment as well, as shown in FIG. 3, the transfer roller shaft 41 is supported by a conductive cover 46 from below (i.e., from the opposite side of the photoconductive drum 3 with respect to the transfer roller shaft 41), and covered with the insulated cover 58 from above (i.e., from the side of the photoconductive drum 3).

Therefore, it is possible to dispose the conductive cover 46 and the insulated cover 58 such that they do not overlap in the radial direction of the transfer roller shaft 41 and to bear the transfer roller shaft 41 by cooperation between the conductive cover 46 and the insulated cover 58.

Thereby, it is possible to downsize the bearing member 35 in the radial direction of the transfer roller shaft 41 and attain a compact configuration for bearing the transfer roller shaft 41 of the transfer roller 9.

Consequently, it is possible to downsize the process cartridge 21 and the printer 1.

Further, in the second embodiment, it is possible to achieve the same advantageous effects as the aforementioned first embodiment.

Hereinabove, the embodiments according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present invention. It is to be understood that the present invention is capable of use in various other combinations and environments and is capable of changes or modifications within the scope of the inventive concept as expressed herein. For example, the following modifications are possible.

6. Modifications

The bearing members 35 exemplified in the aforementioned embodiments as elements for bearing the transfer roller shaft 41 may be employed as rotational members to which a bias voltage is applied such as a cleaning roller, a supply roller, and a development roller of an image forming apparatus.

Further, the bearing members 35 may be employed as bearing members that require electric continuity such as a bearing member for bearing a driving shaft of a motor.

Each bearing member 35 of a modification may be configured such that a conductive cover 46 is disposed adjacent to an insulated cover 58 in a circumferential direction (i.e., a rotational direction) of a rotational member.

In the aforementioned first embodiment, the conductive cover 46 includes the recessed fitting portions 48, and the insulated cover 58 includes the protruding fitting portions 61. However, the insulated cover 58 may include recessed fitting portions formed in the same shapes as the recessed fitting portions 48 of the conductive cover 46, and the conductive cover 46 may include protruding fitting portions formed in the same shapes as the protruding fitting portions 61 of the insulated cover 58.

Further, engagement and fitting mechanisms between the conductive cover 46 and the insulated cover 58 are not limited to the aforementioned engagement between the claw engagement grooves 55 and the engagement claws 62 or the aforementioned fitting between the recessed fitting portions 48 and the protruding fitting portions 61. For example, the conductive cover 46 may be attached to the insulated cover 58 by screw connections.

Thus, it is possible to dispose the conductive cover 46 and the insulated cover such that they do not overlap in the radial direction of a rotational member, to bear the rotational member by cooperation between the conductive cover 46 and the insulated cover 58, and to supply the rotational member with electricity from the power supply 87 via the conductive cover 46.

What is claimed is:

1. A transfer device comprising:

a transfer roller comprising a conductive rotational shaft, the transfer roller being opposed to an external image-carrying body configured to carry a developer image, the transfer roller being configured to transfer onto an image-transferred member the developer image carried by the image-carrying body; and a bearing configured to rotatably support the rotational shaft of the transfer roller, the bearing comprising:

a conductive section formed of conductive material, the conductive section being disposed in a position around the rotational shaft of the transfer roller, the conductive section being configured to bear the rotational shaft from an opposite side of the image-carrying body with respect to the rotational shaft and to be supplied with electricity from an external power supply, the conductive section comprising an engaged portion; and an insulated section formed of insulating material, the insulated section being disposed in a position around the rotational shaft, the insulated section being configured to cover the image-carrying body from a side of the image-carrying body, the insulated section comprising an engaging portion configured to engage with the engaged portion of the conductive section, the engaging portion being formed to extend inward in an axis line direction of the rotational shaft and having an engaging pawl for engaging with the engaged portion of the conductive section.

2. The transfer device according to claim 1, further comprising a frame configured to support the bearing, wherein the conductive section is configured to position the rotational shaft relative to the frame.

3. The transfer device according to claim 2, wherein the frame comprises an attaching portion configured such that the conductive section is attached thereto, the attaching portion comprising a guide portion configured to guide the conductive section such that the conductive section is attached to the attaching portion, and wherein the conductive section comprises a guided portion configured to be guided by the guide portion.

4. The transfer device according to claim 1, wherein the insulated section is configured to, when projected from a side of the image-carrying body in an opposed direction in which the transfer roller is opposed to the image-carrying body, cover a middle portion of the conductive section in a direction perpendicular to the opposed direction and the axis line direction of the rotational shaft.

5. The transfer device according to claim 1, wherein the insulated section comprises:

a covering portion configured to cover the rotational shaft from the side of the image-carrying body; and an opposed portion that is opposed to the conductive section and an end of the rotational shaft in the axis line direction of the rotational shaft.

6. The transfer device according to claim 5, wherein the opposed portion comprises a protruding portion formed to protrude inward in the axis line direction of the rotational shaft, and wherein the conductive section comprises a recessed portion configured such that the protruding portion is fitted thereinto.

7. The transfer device according to claim 1, further comprising an electrode configured to be electrically connected with the conductive section and supplied with electricity from the external power supply.

8. A transfer device comprising:

a transfer roller comprising a conductive rotational shaft, the transfer roller being opposed to an external image-carrying body configured to carry a developer image, the transfer roller being configured to transfer onto an image-transferred member the developer image carried by the image-carrying body;

a bearing configured to rotatably support the rotational shaft of the transfer roller, the bearing comprising:

a conductive section formed of conductive material, the conductive section being disposed in a position around the rotational shaft of the transfer roller, the conductive section being configured to bear the rotational shaft from an opposite side of the image-carrying body with respect to the rotational shaft and to be supplied with electricity from an external power supply; and an insulated section formed of insulating material, the insulated section being disposed in a position around the rotational shaft, the insulated section being configured to cover the image-carrying body from a side of the image-carrying body; and a frame configured to support the bearing, wherein the frame comprises an attaching portion configured such that the conductive section is attached thereto, wherein the insulated section comprises an engaging section that extends in an extending direction toward an opposite side of the image-carrying body with respect to the insulated section and bends inward in an axis line direction of the rotational shaft, and wherein the attaching portion of the frame comprises an engaged section configured to be engaged with the engaging section of the insulated section.

9. A process cartridge configured to be detachably attached to an apparatus main body, comprising:

an image carrying body configured to carry a developer image;

a transfer roller comprising a conductive rotational shaft, the transfer roller being opposed to the image carrying body, the transfer roller being configured to transfer onto an image-transferred member the developer image carried by the image carrying body; and a bearing configured to rotatably support the rotational shaft of the transfer roller, the bearing comprising:

a conductive section formed of conductive material, the conductive section being disposed in a position around the rotational shaft of the transfer roller, the conductive section being configured to bear the rotational shaft from an opposite side of the image carrying body with respect to the rotational shaft and to be supplied with electricity from an external power supply, the conductive section comprising an engaged portion; and an insulated section formed of insulating material, the insulated section being disposed in a position around the rotational shaft, the insulated section being configured to cover the image carrying body from a side of the image carrying body, the insulated section comprising an engaging portion configured to engage with the engaged portion of the conductive section, the engaging portion being formed to extend inward in an axis line direction of the rotational shaft and having an engaging pawl for engaging with the engaged portion of the conductive section.

10. An image forming apparatus comprising:

a process cartridge configured to be detachably attached to an apparatus main body, the process cartridge comprising:

an image carrying body configured to carry a developer image;

a transfer roller comprising a conductive rotational shaft, the transfer roller being opposed to the image carrying body, the transfer roller being configured to transfer onto an image-transferred member the developer image carried by the image carrying body; and a bearing configured to rotatably support the rotational shaft of the transfer roller, the bearing comprising:

a conductive section formed of conductive material, the conductive section being disposed in a position around the rotational shaft of the transfer roller, the conductive section being configured to bear the rotational shaft from an opposite side of the image carrying body with respect to the rotational shaft and to be supplied with electricity from an outside of the process cartridge, the conductive section comprising an engaged portion; and an insulated section formed of insulating material, the insulated section being disposed in a position around the rotational shaft, the insulated section being configured to cover the image carrying body from a side of the image carrying body, the insulated section comprising an engaging portion configured to engage with the engaged portion of the conductive section, the engaging portion being formed to extend inward in an axis line direction of the rotational shaft and having an engaging pawl for engaging with the engaged portion of the conductive section; and a power supply configured to supply electricity to the conductive section.

11. An image forming apparatus comprising:

an image carrying body configured to carry a developer image;

a transfer device comprising:

a transfer roller comprising a conductive rotational shaft, the transfer roller being opposed to the image carrying body, the transfer roller being configured to transfer onto an image-transferred member the developer image carried by the image carrying body; and a bearing configured to rotatably support the rotational shaft of the transfer roller, the bearing comprising:

a conductive section formed of conductive material, the conductive section being disposed in a position around the rotational shaft of the transfer roller, the conductive section being configured to bear the rotational shaft from an opposite side of the image carrying body with respect to the rotational shaft and to be supplied with electricity from an outside of the transfer device, the conductive section comprising an engaged portion; and an insulated section formed of insulating material, the insulated section being disposed in a position around the rotational shaft, the insulated section being configured to cover the image carrying body from a side of the image carrying body, the insulated section comprising an engaging portion configured to engage with the engaged portion of the conductive section, the engaging portion being formed to extend inward in an axis line direction of the rotational shaft and having an engaging pawl for engaging with the engaged portion of the conductive section; and a power supply configured to supply electricity to the conductive section.

* * * * *